United States Patent [19]

Thibeault et al.

[11] Patent Number: 4,930,654

[45] Date of Patent: Jun. 5, 1990

[54] RESEALABLE FLIP-TOP CAN

[76] Inventors: Richard A. Thibeault; Deborah M. Thibeault, both of 7 Saxford La., Nashua, N.H. 03063

[21] Appl. No.: 331,682

[22] Filed: Mar. 30, 1989

[51] Int. Cl.[5] ..... B65D 51/18

[52] U.S. Cl. ..... 220/253; 220/258; 220/336; 220/90.2

[58] Field of Search ..... 220/253, 256, 258, 336, 220/90.2, 90.4, 90.6; 215/230, 236

[56] References Cited

U.S. PATENT DOCUMENTS

| | | | |
|---|---|---|---|
| 3,486,665 | 12/1969 | Croce | 220/253 X |
| 3,889,842 | 6/1975 | Bennett | 220/253 |
| 4,098,439 | 7/1978 | Blow, Jr. et al. | 220/90.6 X |
| 4,463,866 | 8/1984 | Mandel | 220/258 X |
| 4,548,331 | 10/1985 | Montgomery | 220/253 |
| 4,579,257 | 4/1986 | Brandlein | 220/90.6 X |
| 4,598,837 | 7/1986 | Kreiseder et al. | 220/253 |
| 4,715,510 | 12/1987 | van der Meulen et al. | 220/90.4 |
| 4,717,039 | 1/1988 | Ayyoubi | 220/253 |
| 4,752,016 | 6/1988 | Eads | 220/253 |
| 4,790,444 | 12/1988 | Terzi | 220/90.2 |
| 4,852,736 | 8/1989 | Dimberio | 220/253 |

*Primary Examiner*—Stephen Marcus
*Assistant Examiner*—Nova Stucker
*Attorney, Agent, or Firm*—Joseph Funk

[57] ABSTRACT

What is disclosed is a resealable flip-top beverage can having a rotatable sealing top mounted above the can top of the beverage can, and the sealing top is rotated into a first position to open a hole in the top of the beverage can and through which the contents of the can are dispensed, and is rotated into a second position where the sealing top seals the hole. Sealing means are provided on the top of the can top and on the underside of the sealing top that cooperate to seal the beverage can. A separate actuating means may be snapped onto the top of the beverage can and is coupled to the sealing top so that as the actuating means is rotated the sealing top is rotated. Alternatively, the sealing top may have a downturned, knurled edge extending over the side of the beverage can, and the edge is grasped and rotated to open and close the beverage can.

14 Claims, 2 Drawing Sheets

RESEALABLE FLIP-TOP CAN

FIELD OF THE INVENTION

This invention relates to flip-top beverage cans, and more particularly to flip-top cans that are resealable after they have been opened.

BACKGROUND OF THE INVENTION

In the prior art there are beverage containers that may be resealed after they have been opened. One type of such containers are glass or plastic bottles that are resealed by separately purchased devices that are placed in or on the openings of the bottles. Another type are the glass or plastic bottles that have screw-on caps. The caps may be replaced to reseal the bottle.

While screw-on cap bottles may be resealed, other beverage containers cannot be resealed, as the popular flip-top beverage container, because of the easy to use and convenient flip-top tab. Although this device eliminates the need for a can opener or similar opening device the beverage industry has neglected to satisfy the need for a flip-top can that can be resealed once it is opened.

Thus, there is a need in the art for a flip-top beverage can that can be opened in the manner well known in the art, but which is able to be resealed and enables the consumer to take precautions against possible health risks and prevent spoilage of the contents. This makes a resealable flip-top can much more unique.

There is also a need in the art for a flip-top beverage can that has integral resealing means, and that can be resealed without the need for separate sealing means such as a snap-on cap.

SUMMARY OF THE INVENTION

The foregoing needs of the prior art are satisfied by the present invention which is a resealing means that is an integral part of the beverage can. The top of the novel resealable flip-top can has a sealing top that is mounted on top of the conventional flip-top opening top. After the can has been opened in conventional manner, the sealing top is designed to seal the opening in the top of the can made using the conventional tab ring that is affixed to the top of the can. This makes the novel resealable flip-top beverage can airtight and leakproof.

Our mechanism is an innovative solution to the need for a resealable flip-top can. By using our mechanism with existing flip-top cans it enables consumers to reseal the can to preserve the contents, and minimizes loss of carbonation when the beverage is not consumed immediately. This mechanism provides and airtight and leakproof seal once the can is opened and is closed properly. In addition to preserving the quality of the beverage in the can, our mechanism solves health and safety problems in the prior art with flip-top cans. Allowing a consumer to reseal a flip-top can allows them to take precautionary measures against the contamination of the contents, either by pollutants in the atmosphere, as in work places such as auto body and woodworking shops, and on construction sites. Resealable flip-top cans are very practical on outings, picnics and other outdoor activities in that they remove the fear of foreign objects such as insects falling from trees, flying insects and crawling insects from getting into the beverage can. It also makes it less convenient for individuals to deposit unwanted items such as cigarette butts into an open, unattended can before the contents have been completely consumed. The above listed instances pose real health risks should the contents thereafter be consumed.

Our resealable flip-top can also has a very practical advantage. It minimizes the chances of accidental spills that are very messy to clean up. Our resealable top mechanism provides a leakproof seal when closed properly.

BRIEF DESCRIPTION OF THE DRAWING

The present invention will be better understood upon reading the following detailed description in conjunction with the drawing in which.

DETAILED DESCRIPTION

Figure 1:
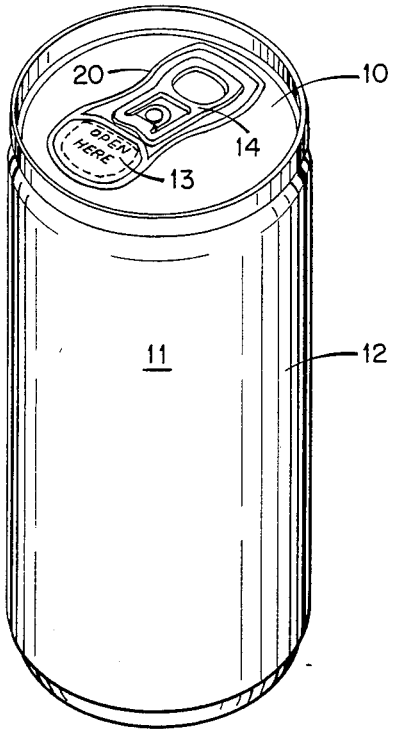
FIG. 1 is a top orthogonal view of the top of a conventional flip-top can with opening tab ring, modified slightly to provide sealing in accordance wih the teaching of the invention.

In FIG. 1 is shown a view of a can top 10 of a conventional flip-top beverage can 11. Ridge 20 and the "CLOSED" AND "OPEN HERE" indicia are not part of the prior art can top 10, but are added to implement the present invention. As is known, can top 10 is manufactured separately from the container portion 12 of the can and is attached to container portion 12 after a beverage is placed therein. There is a scoring 13 (shown as a dotted line) partially through can top 10. Scoring 13 is pushed down using ring 14 in a manner well known in the art to open a hole 15 using scoring 13 so that the contents of can 11 may be dispensed. In the prior art ring 14 is fastened to the middle of conventional can top 10 with a rivet type protrusion 16 that is formed as part of can top 10. When ring 14 is lifted, in a manner known in the art, a portion thereof is forced down against the portion of can top 10 within scoring 13 to rupture can top 10 within the area enclosed by scoring 13 and thereby open beverage can 11. The beverage in container portion 12 may then be consumed. In the prior art, once can 11 is opened there is no way to reseal the can to preserve the unused beverage inside the can.

To implement our present resealable top invention some changes are made to the conventional can top 10. First, during manufacture of can top 10 there is an elongated, oval, raised ridge 20 formed around hole 15 that extends to the opposite side of top 10 as is shown in FIG. 1. The function of this ridge in implementing the invention is described further in this detailed description. Second, rivet type protrusion 16 is made a little longer to captivate not only ring 14, but also another member (a sealing top 17) that is used in implementing the invention. In addition, the indicia "CLOSED" and "OPEN HERE" are stamped into the upper surface of can top 10 to aid in using the present invention as is described further in this detailed description. Alternatively, other indicia may also be stamped into can top 10. In the preferred embodiment conventional can top 10 and ring 14 are preassembled with a new sealing top 17 before they are attached to container 12 to complete beverage can 11 in the same manner as is presently done in the prior art.

Figure 2:
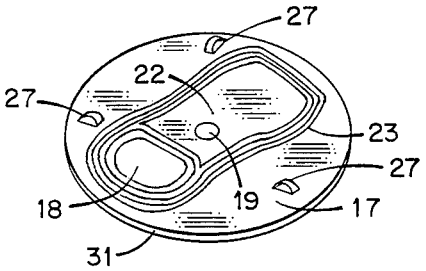
FIG. 2 is a top orthogonal view of a sealing top piece used to reseal the open top of the resealable flip-top can of the present invention.

In FIG. 2 is shown a new sealing top 17 that is used in conjunction with modified, conventional can top 10 to implement the present invention and provide a resealable beverage can 11. New sealing top may be formed of the same type of material as can top 10 and container portion 12 are made of, and may be formed by a single stamping action. However, the raw metal sheet used to form sealing tops 17 also has a layer of a rubber type plastic 31 bonded to its bottom surface, and is used to implement the resealing action as will be better understood in reading further in this detailed description. The rubber type plastic material 31 may be of the same type as is used inside screw off bottle caps and used to seal those bottles, or may be of other sealing materials well known in the prior art.

In a preferable one step forming action of sealing top 17 it has an opening 18 stamped therethrough that is of the same shape and size as hole 15 in can top 10 created when beverage can 11 is opened. Formed in sealing top 17 are two downwardly extending, arctuate raised ridges 22 and 23. Ridges 22 and 23 are elongated and oval and extend across top 17 including surrounding hole 15. The rubber type plastic material 31 is, accordingly, over the peaks of the downwardly extending, parallel ridges 22 and 23. Ridges 22 and 23 and how they cooperate with ridge 20 formed in the top of can top 10 to provide a resealable flip-top can 11 is described further in this detailed description.

In stamping out sealing top 17 there is created a small central hole 19 through top 17. As briefly describd previously, sealing top 17 and ring 14 are pre-attached to the upper or outer surface of can top 10 using the slightly longer rivet type protrusion 16. When being attached together with can top 10 and ring 14 by rivet type protrusion 16, sealing top 17 has its surface that is coated with rubber type plastic material 31 facing downward toward can top 10. The assembly of can top 10, sealing top 17 and ring 14 are thereafter fastened to the top of container 12 after it has been filled with a beverage.

Ridges 22 and 23 formed in sealing top 17 provide a rigidity to sealing top 17 that aids in the sealing action between top 17 and can top 10. If additional rigidity is desired, depending on the material that sealing top 17 is made of, additional ridges (not shown) may be formed in top 17.

Sealing top 17 also has three upwardly extending, stamped protrusions 27 located at a radial distance R from hole 19. Protrusions 27 are rounded in a radial orientation with top 17, and metal of top 17 is torn on two opposed sides of protrusions 27 to create essentially vertical sides in a circular orientation. Protrusions 27 are used to rotate sealing top 17 to reopen and reseal can 11 as described further in this detailed description.

In the preferred embodiment of the invention the complete top comprising elements can top 10, rivet 14 and sealing top 17 is assembled separately from container portion 12. As is known in the art, a container portion 12 is filled with a beverage and then an assembled can top is attached thereto by rolling their edges together. However, in an alternative embodiment of the invention described further in this detailed description, elements 10, 14 and 17 are not pre-assembled, but can top 10 is first attached to container portion 12, and then ring 14 and sealing top 17 are attached to can top 10 using a special rivet.

Sealing top 17 has a smaller diameter than can top 10 so that it comes up to the inside of the rolled edge rim of completely assembled beverage can 11. Top 17 can be rotated under rivet type protrusion 16 so that its opening 18 can be in registration with hole 15 throug can top 10 after it is opened to dispense a beverage in can 11, or it may be rotated one-hundred eighty degrees so that beverage container 11 may be resealed per the teaching of the present invention.

To provide resealing of beverage can 11 per the teaching of the present invention, and to also prevent beverage inside can 11 from getting between can top 10 and sealing top 17 there is a seal provided between these two parts. As previously described with reference to FIG. 1, there is an upwardly extending, oval raised ridge 20 that goes across can top 10 and passes around hole 15. As previously described with reference to FIG. 2, novel sealing top 17 has two downwardly extending, oval, parallel ridges 22 and 23 stamped therein. The spacing between ridges 22 and 23 is the same as the width of upwardly extending raised ridge 20 on can top 10.

When hole 18 through sealing top 17 is in registration with hole 15 in can top 10 to dispense beverage from opened can 11, upwardly extending raised ridge 20 that passes around hole 15 and across top 10 lies between downwardly extending, oval raised ridges 22 and 23 on sealing top 17. To create an effective seal preventing beverage from getting between sealing top 17 and can top 10 when can 11 is opened, the rubber type plastic material 31 on the bottom surface of sealing top 17 and over downwardly extending ridges 22 and 23 is pressed against upwardly extending ridge 20.

When an opened beverage can 11 is resealed by rotating sealing top 17 one-hundred eighty degrees, upwardly extending raised ridge 20 that passes around hole 15 and across top 10 again lies between downwardly extending, oval raised ridges 22 and 23 on sealing top 17, except that ridges 22 and 23 have been rotated one-hundred eighty degrees. In this position hole 15 is sealed since there is no hole through sealing top 17 in the area that is now over hole 15. There is an effective resealing of opened beverage can 11, because the rubber type plastic material 31 on the bottom surface of sealing top 17 and over downwardly extending ridges 22 and 23 is again pressed against upwardly extending ridge 20.

In either the open position or the closed position of sealing top 17 there are created vertical forces against top 17. To prevent the edges of sealing top 17 from bowing upward from the vertical forces the stiffening action of ridges 22 and 23 is utilized. It is sufficient to provide a very effective sealing pressure between can top 10 and sealing top 17. In addition, rivet 14 holds plastic material 31 on the underside of sealing top 17 so firmly against the upper surface of can top 10 that it creates a good seal that prevents liquid and carbon dioxide from can 11 from escaping around rivet 14.

Due to the rounded cross section of all the ridges, when sealing top 17 is rotated between its open position and its closed position, ridges 20, 22 and 23 cam upward over each other and ridges 22 and 23 are on top of ridge 20 in the central portion of can top 10 between the two positions.

To give a positive indication that a flip-top can 11 equipped with the novel resealing top 17 of the present invention has never been opened, or has been opened but is resealed, indicia are stamped into the metal of can top 10 during its manufacture. On the metal within scoring 13 (where hole 15 is created using ring 14) is stamped "OPEN HERE"; while in the metal on the opposite side of can top 10 is stamped "CLOSED". The same indicia in another language may be stamped alongside the English indicia for distribution in areas that have a high non-English speaking population. Alternatively, graphic symbols conveying the same information may be stamped in can top 10. In the preferred embodiment of the usage of the invention a beverage can 11 is shipped with hole 18 through sealing top 17 over the as yet unopened hole 15 so that the indicia "OPEN HERE" is seen. Without such indicia, when beverage can 11 has been unopened it is not known whether hole 18 through rotatable sealing top 18 is in registration with as yet unopened hole 15, or is rotated one-hundred eighty degrees and hole 18 is over the opposite side of can top 10. Other indicia may also be stamped into the upper surface of can top 10 that indicate if rotatable sealing top 17 is in an intermediate position between its fully open or fully closed positions. All these indicia cooperate to properly use resealing top 17 and to prevent attempting to open can 11 when sealing top 17 is in the wrong position which may result in breaking can opening ring 14.

In an alternative emodiment of the invention ring 14 may be spot welded or otherwise be more permanently attached to rivet 16, after the top has been assembled with rivet 16, but before the assembled top has been attached to container portion 12, to prevent ring 14 from being rotated. This alternative embodiment is useful if it is believed that consumers cannot or will not observe the indicia or graphic symbols. It is easily observable that hole 18 through sealing top 17 is under the portion of ring 14 that pushes downward to open hole 15 of can 11 when the opposite end of ring 14 is pulled upwards as is well known.

Figure 3:
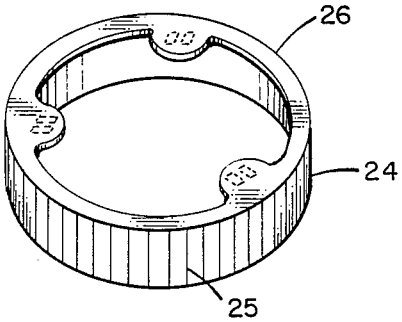
FIG. 3 shows an actuating piece used to rotate the sealing top piece.

While sealing top 17 may be used alone, in the preferred embodiment of the invention a plastic actuating means 26 shown in FIG. 3 is provided. Actuating means 26 is preferably manufactured of plastic. It may be seen that actuating means 26 has its middle area selectively removed so that can top 10 and sealing top 17 may be seen and the contents of can 11 may be dispensed. Actuating means 26 has downwardly extending, turned under edges that are shown in detail in FIG. 4, and is of a diameter that actuating means 26 is permanently snapped onto the top of beverage can 11 with can top 10 attached thereto by elastic action as the last step of manufacture. The thickness of, and the type of plastic from which actuating means 26 is fabricated provides an elastic action strong enough that it is not easily removed from can 11. The inside and outside diameter dimensions of actuating means 26 are such that it can be grasped and easily rotated in its installed position on can 11. The sides 24 of actuating means 26 are long enough, and are knurled 25, so that actuating means 26 is easily grasped and turned to open and close can 11.

In addition, the underside of actuating means 26 contacts the top outer edge of sealing top 17 to provide additional resistance to upward forces that lessen the sealing action between can top 10 and sealing top 17 that has been described in the previous paragraphs.

Figure 4:
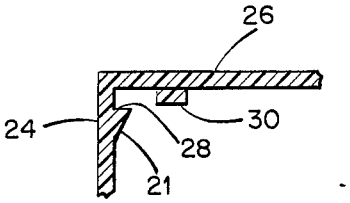
FIG. 4 is a side cutaway view of a part of the actuating piece showing detail of how it is retained on the top of the can.

On the underside of plastic actuating means 26, on the portions 33 that are not removed from the central portion, are formed a few pairs of downwardly extending plastic protrusions 30 that have substantially vertical sides. One of these protrusions 30 is shown in FIG. 4. Plastic protrusions 30 are all located a radial distance R from the geometric center of actuating means 26. This radial distance is the same as for the metal protrusions 27 stamped in sealing top 17. Plastic protrusions 30 are angularly spaced around means 26 at the same angular orientation as metal protrusions 27 formed on sealing top 17. Each of the pairs of downwardly extending plastic protrusions 30 are spaced apart a distance slightly greater than the width of an upwardly extending, stamped protrusion 28.

When plastic actuating means 26 is permanently snapped onto the top of beverage can 11 each of the pairs of plastic protrusions 28 on the underside of actuating means 26 straddle one of the upwardly extending metal protrusions 28 on sealing top 17. As actuating means 26 is manually rotated either clockwise or counter-clockwise using knurled edge 24, the plastic protrusions 28 engage the upwardly extending metal protrusions 28 and cause sealing top 17 to also be rotated. In this manner beverage can 11 is resealed and reopened using plastic actuating means 26.

In FIG. 4 is shown a side cutaway view of plastic actuating means 26. It may be seen that the edge of means 26 has a beveled section 21 that enables means 26 to be snapped onto can 11 at the last step of manufacture, but the flat section 28 that then lies under the rolled edge of can 11 prevents actuating means 26 from easily being removed. In FIG. 4 is also shown one of the downwardly extending plastic protrusions 30.

Figure 5:
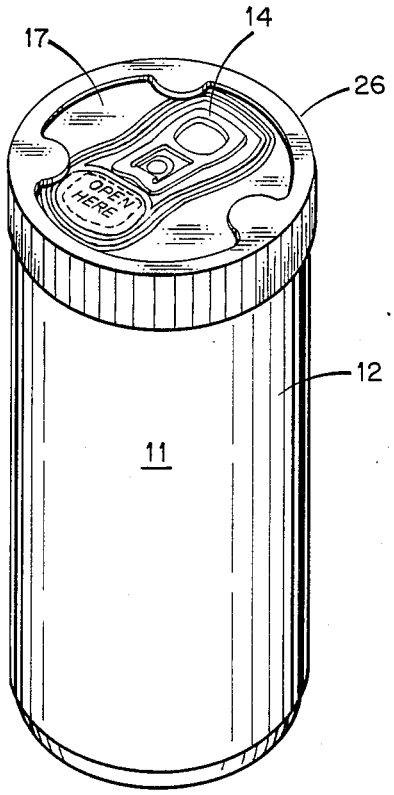
FIG. 5 shows a beverage can including a sealing top piece and actuating means.

In FIG. 5 is shown a fully assembled, resealable flip-top can in accordance with the teaching of the present invention. Actuating means 26 is shown in the position where hole 18 through sealing top 17 is in registration with as yet unopened hole 15 through can top 10. In this position the "OPEN HERE" indicia on can top 10 is seen.

Figure 6:
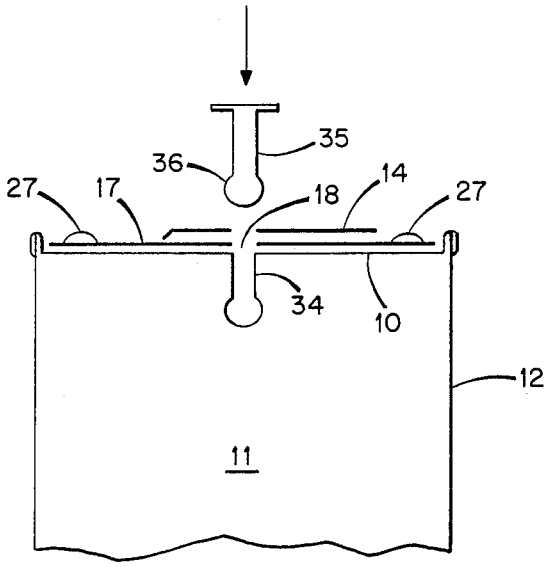
FIG. 6 shows an exploded side view of a first alternative embodiment of the invention for assembly of the sealing top to the can top.

An alternative embodiment of the invention is shown in FIG. 6. In this Figure are shown in an exploded side view, a modified can top 10, sealing top 17, ring 14 and a special rivet 35 used to hold them together. In this alternative embodiment of the invention the can top 10, ring 14 and sealing top 17 are not preassembled before they are attached to a container 12 to complete a beverage can 11. Prior art can tops 10 are formed using metal drawing/forming techniques that create the rivet type protrusion 16 extending upward from the metal of can top 10. In this alternative embodiment of the invention the same metal drawing/forming techniques are used to create a protrusion 34 that is hollow, and extends downward inside an assembled beverage can 11. Protrusion 34 has a flared end that is created by a using a jig that holds the central portion of initially formed protrusion 34 while the closed end is pressed down by a domed element. For assembly, a special rivet 35 having a flared end 36 is used. The diameter of the main portion of the shaft of rivet 35 has the same diameter as the inside diameter of the central portion of protrusion 34, and the flared end 36 has the same diameter as the inside of the flared end of protrusion 34. After a container 12 is filled with a beverage, a can top 10 with a downwardly extending protrusion 34 is attached thereto in conventional manner. Thereafter, rivet 35 is placed through a mounting hole through an opening ring 14, through central hole 18 in sealing top 17, and the flared end 36 of rivet 35 is inserted into the hollow interior of downwardly extending protrusion 34 in can top 10. The flared end 36 of rivet 35 temporarily deforms the central portion of protrusion 34 without exceeding the elastic limit of the metal. The flared end 36 of rivet 35 finally passes into the interior of the flared end of protrusion 34 and is thereby retained therein by the elastic action of the metal of central portion of protrusion 34. A small amount of adhesive (not shown) may be injected into the interior of the flared end of protrusion 34 before rivet 35 is inserted to better retain rivet 35 therein.

Figure 7:
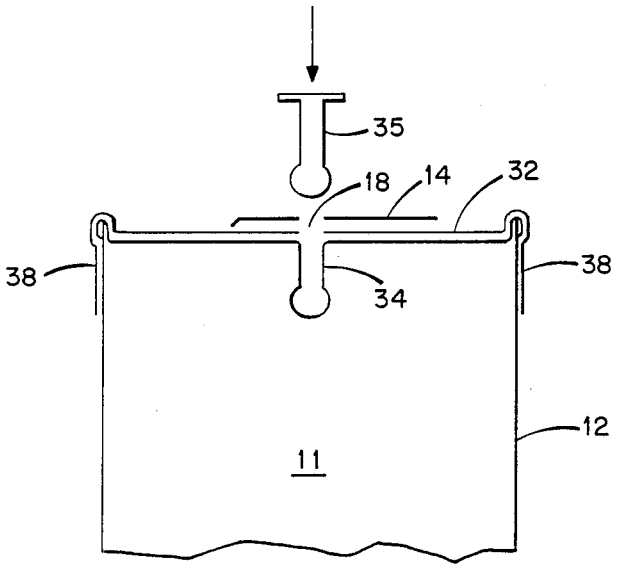
FIG. 7 shows a second alternative embodiment of the invention which is a sealing top with a downturned edge that precludes the need for a separate actuating means.

A second alternative embodiment of the invention is shown in FIG. 7. This second alternative embodiment of the invention is used with some of the teaching of the alternative embodiment of the invention shown in FIG. 6 and described in the last paragraph. With this second alternative embodiment, a separate plastic actuating means 26 is not required. Rather, a different sealing top 32, shown in FIG. 7, and having an extended, turned down side edge 38 is utilized. The extended edge is formed downward to form a side edge 38 that is knurled and extends over the outside edge of can 11. Knurled side edge 38 provides a place to grip and rotate the revised sealing top 32 into the open and closed positions of can 11. Can top 10 is attached to a filled container 12 using the rolled edges known in the art. Revised sealing top 32 is then placed over can top 10, and special rivet 35 is inserted through ring 14 and a central hole 18 through revised sealing top 32 to be inserted into the alternative hollow, downward protrusion 34 as described hereinabove. The can 11 is put through a final manufacturing step where side edge 38 is crimped below the rolled edge where can top 10 is fastened to container portion 12. The resultant crimp helps in holding revised sealing top 32 onto the assembled can, provides a way that revised sealing top 32 may be rotated without separate actuating means, and helps provide downward pressure that aids in the sealing action.

While what has been described hereinabove is the preferred embodiment of the invention it should be understood that those skilled in the art may make numerous changes without departing from the spirit and scope of the invention. For example, the number of plastic and metal actuating means may be varied, or the exact form of the actuating means may be varied. In addition, the number or shape of the stiffening ribs formed in the sealing top may be changed, or not used at all. Further, rather than using a uniform thickness layer of rubber type plastic in conjunction with formed ridges on the sealing top, on ridges need be formed and, instead, a rubber type plastic piece having ridges formed therein may be bonded to the underside of the sealing lid. Also, the number, configuration, or shape or sealing ridges may be varied. Still further, other sealing means may be implemented by those skilled in the art. Yet further, a discrete rivet may be used to assemble the can top, sealing top and opening ring.

What we claim is:

1. A resealable flip-top fastenable to a container of a beverage can and opened by a ring, said resealable flip-top comprising:

a can top having a first area that is ruptured by said ring fastened to said can top by a rivet to thereby open a first opening of said can in order to dispense a beverage therein; and a circular sealing top permanently fastened to the top of said can top, said sealing top covering substantially all of said can top, said sealing top having a second opening, and that must be moved into a first position where it is in registration with said first opening in order to dispense the beverage in said can, said sealing top being moved into a second position where said second opening is out of registration with said first opening in order to reseal said can.

2. The invention in accordance with claim 1 further comprising a first sealing means cooperating with said sealing top for sealing said first opening when said sealing top is in said second position to reseal said can.

3. The invention in accordance with claim 2 further comprising a second sealing means that cooperates with said sealing top when it is in said first position to prevent said beverage being dispensed from getting between said can top and said sealing top when said can is tipped sideways to dispense said beverage inside said can.

4. The invention in accordance with claim 1 further comprising:

actuating means that is attached to the top of said beverage can, said actuating means being manually operated after said can has been opened, and said actuating means cooperates with said sealing top to move same into either said first position to open said can, or into said second position to reseal said can.

5. The invention in accordance with claim 4 further comprising:

first means on said sealing top;

second means on said actuating means, said second means engaging said first means to move said sealing top to open said can or to reseal said can when said actuating means is operated.

6. The invention in accordance with claim 5 wherein said sealing top is rotatable attached to said can top and said actuating means rotates said sealing top into said first and said second positions.

7. The invention in accordance with claim 6 wherein said first means comprises first protrusions extending upward from said sealing top, and said second means comprises second protrusions extending downward from said actuating means, said first protrusions engage said second protrusions when said actuating means is attached to the top of said beverage can, and as said actuating means is manually turned said second protrusions push against said first protrusions and cause said sealing top to rotate to either said first position to open said beverage can, or to said second position to reseal said beverage can.

8. The invention in accordance with claim 7 wherein said first sealing means comprises an upwardly extending raised first ridge on the top of said can top and passing around said first opening, and said second sealing means comprises a pair of parallel, downwardly extending, second raised ridges on the bottom of said sealing top and passing around said second opening, and when said sealing top is rotated into either said first position or said second position to respectively open or reseal said beverage can, said first ridge comes into contact with said second ridges to provide a seal which seals said first opening when said sealing top is in said first position, and prevents said beverage from getting between said can top and said sealing top when said sealing top is in said second position.

9. The invention in accordance with claim 8 further comprising a flexible layer on the underside of said sealing top including over said second ridges, said flexible layer creating a good seal between said first and said second ridges when said sealing top is in either said first position or said second position.

10. The invention in accordance with claim 1 wherein said sealing top has a downturned edge that extends over the side of said beverage can, and said downturned edge is grasped and turned to rotate said sealing top between said first position and said second position.

11. A resealable flip-top beverage can comprising:

a container for holding a beverage;

a can top having a first area that is ruptured to open a first opening of said can in order to dispense a beverage therein;

a rivet in the middle of said can top;

a ring attached to said can top by said rivet for rupturing said first area to open said beverage can;

a circular sealing top permantly fastened to the top of said can top by said rivet, said sealing top covering substantially all of said can top, said sealing top having a second opening that must be moved into a first position where it is in registration with said first opening in order to dispense the beverage in said can, and said sealing top being moved into a second position where said second opening is out of registration with said first opening in order to reseal said can, and said can top, said ring and said sealing top being attached to said container; and a first sealing means cooperating with said sealing top for sealing said first opening when said sealing top is in said second position to reseal said can.

12. The invention in accordance with claim 11 further comprising:

actuating means that is attached to the top of said beverage can, said actuating means being manually operated after said can has been opened, and said actuating means cooperates with said sealing top to move same into either said first position to open said can, or into said second position to reseal said can.

13. The invention in accordance with claim 11 wherein said sealing top has a downturned edge that extends over the side of said beverage can, and said downturned edge is grasped and turned to rotate said sealing top between said first position and said second position.

14. The invention in accordance with claim 11 wherein said can top has a protruberance formed in the middle thereof, said protruberance extending downward into the interior of said container when said can top is attached thereto, said protruberance having a hollow tubular portion that extends downward from the bottom surface of said can top and a hollow bulbous portion at the end of said protruberance furthest away from said can top;

wherein said rivet has a flat head, an elongated shaft, and a bulbous portion on the end of said shaft furthest away from flat head, the diameter of said bulbous portion being substantially equal to the diameter of the hollow bulbous portion at the end of said protruberance and the diameter of said shaft being substantially equal to the diameter of said hollow tubular portion of said protruberance, and wherein said ring and said sealing top are attached to said can top by said rivet by inserting said bulbous end thereof through a hole through said ring and through a hole through said sealing top and pushing said bulbous end through the hollow tubular portion of said protruberance until it is inside said hollow bulbous portion at the end of said protruberance, and the material from which said can top is fabricated of expanding when the bulbous end of said rivet is pushed therethrough and contracting when said bulbous end of said rivet enters the hollow bulbous portion at the end of said protruberance to firmly hold said rivet with said ring and said sealing top thereon to said can top.

* * * * *